US010340612B2

(12) United States Patent
Martin et al.

(10) Patent No.: US 10,340,612 B2
(45) Date of Patent: Jul. 2, 2019

(54) PRESSURE BAR FOR CONNECTORS

(71) Applicant: Hubbell Incorporated, Shelton, CT (US)

(72) Inventors: Evan Ronald Martin, Derry, NH (US); Mike David Bailly, Littleton, NH (US); Bob Alan Hammond, New Hampton, NH (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 15/255,380

(22) Filed: Sep. 2, 2016

(65) Prior Publication Data

US 2017/0069977 A1 Mar. 9, 2017

Related U.S. Application Data

(60) Provisional application No. 62/213,824, filed on Sep. 3, 2015.

(51) Int. Cl.

| | |
|---|---|
| ***H01R 4/38*** | (2006.01) |
| ***H01R 4/32*** | (2006.01) |
| ***H01R 4/36*** | (2006.01) |
| ***H01R 11/07*** | (2006.01) |
| ***H01R 4/30*** | (2006.01) |

(52) U.S. Cl.

CPC ..... *H01R 4/38* (2013.01); *H01R 4/301* (2013.01); *H01R 4/32* (2013.01); *H01R 11/07* (2013.01)

(58) Field of Classification Search

CPC . H01R 4/36; H01R 4/64; H01R 11/07; H01R 4/32; H01R 4/363; H01R 4/34; H01R 4/38; H01R 11/12

USPC ..... 439/798, 810, 100, 778, 797, 779, 814, 439/97, 101

See application file for complete search history.

(56) References Cited

U.S. PATENT DOCUMENTS

| | | | | |
|---|---|---|---|---|
| 2,148,960 A | | 4/1933 | Peirce, Jr. | |
| 2,164,006 A | * | 6/1939 | Dibner | H01R 4/32 439/779 |
| 2,218,210 A | | 10/1939 | Mebold | |
| 2,180,931 A | * | 11/1939 | Rogoff | H01R 4/32 439/778 |
| 2,546,395 A | | 11/1945 | Hubbard | |
| 2,450,158 A | * | 9/1948 | Pennell | H01R 4/26 403/396 |
| 2,816,274 A | | 5/1954 | Barlow | |
| 3,052,868 A | | 6/1958 | Margolies | |

(Continued)

FOREIGN PATENT DOCUMENTS

| | | |
|---|---|---|
| FR | 2725078 | 3/1996 |
| JP | 8106931 | 4/1996 |

*Primary Examiner* — Amy Cohen Johnson
*Assistant Examiner* — Matthew T Dzierzynski
(74) *Attorney, Agent, or Firm* — Michael Best & Friedrich, LLP

(57) ABSTRACT

An electrical connector includes a split bolt, a fastener component, and a pressure bar. The split bolt includes a base, a first upright member, a second upright member, and a conductor receiving channel defined between the first and second upright members. The fastener component has a top surface, a bottom surface, and an opening receiving the first and second upright members. The pressure bar has a bottom section, a first leg, and a second leg. The pressure bar is movably received in the conductor receiving channel.

19 Claims, 4 Drawing Sheets

(56) References Cited

U.S. PATENT DOCUMENTS

| | | | | |
|---|---|---|---|---|
| 3,125,398 | A * | 3/1964 | Wolf | H01R 4/363<br>439/798 |
| 4,147,446 | A * | 4/1979 | Frank, Jr. | H01R 4/32<br>403/373 |
| 5,129,844 | A | 7/1992 | Goto et al. | |
| 5,236,377 | A | 8/1993 | Goto | |
| 7,963,811 | B2 | 6/2011 | Wason et al. | |
| 7,988,503 | B2 | 8/2011 | King, Jr. et al. | |
| 8,277,263 | B1 | 10/2012 | Smith | |
| 8,974,254 | B2 * | 3/2015 | Esmacher | H01R 4/38<br>439/779 |
| 9,287,637 | B2 * | 3/2016 | Therrien | H01R 4/38 |

* cited by examiner

PRESSURE BAR FOR CONNECTORS

FIELD

Various exemplary embodiments relate to a pressure bar for a connector, for example a split bolt connector.

BACKGROUND

Split bolt electrical connectors are typically used to electrically and mechanically connect two conductors, such as a tap conductor and a main conductor. The tap and main conductors are inserted into a channel in the split bolt connector. A nut is threadably connected to the split bolt electrical connector to axially move an insert into engagement with the conductors to secure the conductors in the connector.

SUMMARY

According to an exemplary embodiment, an electrical connector includes a split bolt, a fastener component, and a pressure bar. The split bolt includes a base, a first upright member, a second upright member, and a conductor receiving channel defined between the first and second upright members. The fastener component has a top surface, a bottom surface, and an opening receiving the first and second upright members. The pressure bar has a bottom section, a first leg, and a second leg. The pressure bar is movably received in the conductor receiving channel.

According to another exemplary embodiment, a pressure bar for an electrical connector includes a bottom section having a groove for contacting a conductor. A first leg extends from the bottom section. A second leg extends from the bottom section. A first transition between the first leg and the bottom section forms a first shoulder. A second transition between the second leg and the bottom section forms a second shoulder.

According to another exemplary embodiment, a method of making an electrical connection includes inserting a conductor into a channel of a split bolt connector. A pressure bar is inserted into the channel, the pressure bar has a bottom section, a first leg, and a second leg. A fastener component is connected to the split bolt connector so that the first and second legs extend through an opening in the fastener component. The position of the fastener component is adjusted to move the pressure bar into engagement with the conductor.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

Figure 1:
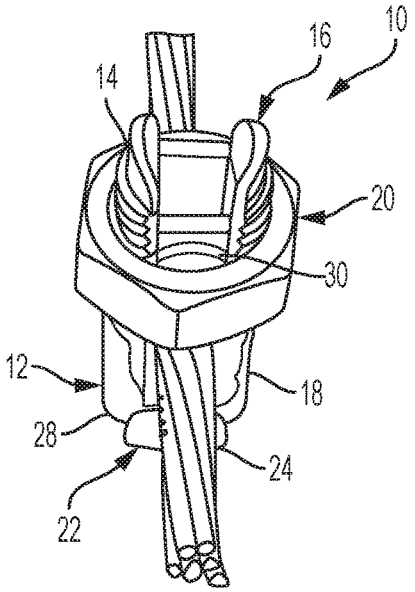
FIG. 1 is a top perspective view of the exemplary connector assembly.
Figure 2:
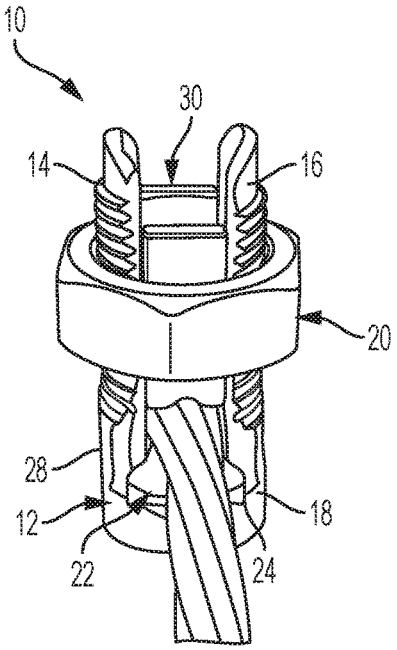
FIG. 2 is a front perspective view of FIG. 1.
Figure 3:
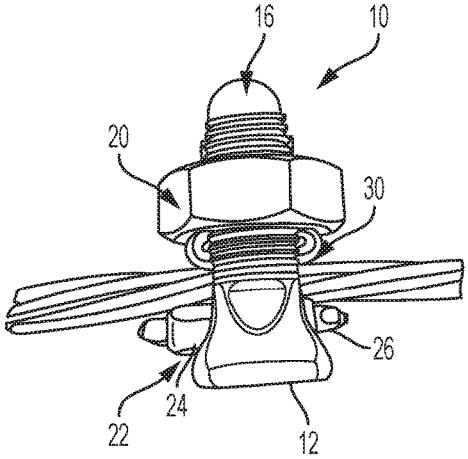
FIG. 3 is a side perspective view of FIG. 1.
Figure 4:
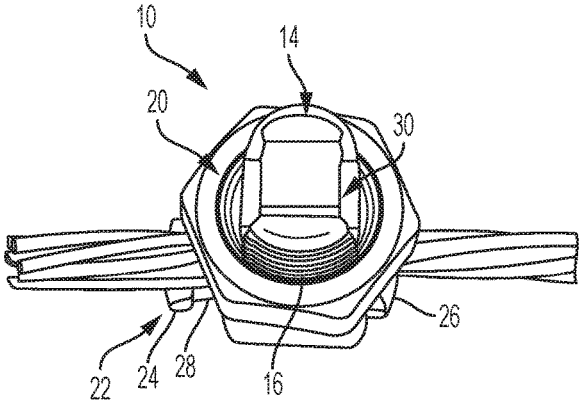
FIG. 4 is another top perspective view of FIG. 1.

According to various exemplary embodiments, an electrical connector includes a split bolt assembly 10 having a base 12, a first upright member 14, and a second upright member 16. A conductor receiving channel 18 is at least partially defined between the first and second upright members 14, 16. A fastener component 20 engages the first and second upright members 14, 16. The fastener component 20 has upper and lower surfaces and an opening. In some embodiments, the fastener component 20 is a threaded nut and the first and second upright members 14, 16 can include an exterior thread for receiving the nut. The fastener component 20 can also be a type of rivet, locking clamp, or other similar fastener.

A first insert, for example a spacer bar 22, is positioned in the bottom of the channel 18 near the base 12. The spacer bar 22 can include a first end 24, a second end 26, and a middle portion 28 extending between the first and second ends 24, 26. In an exemplary embodiment, the first and second ends 24, 26 have a width greater than the width of the middle portion 28 and greater than the width of the channel 18 to prevent inadvertent removal of the spacer bar 22 from the channel 18.

A second insert, for example a pressure bar 30, is movably received in the channel 18. The pressure bar 30 is positioned to engage a conductor received in the channel 18 and the fastener component 20. The position of the pressure bar 30 can be adjusted or set by the fastener component 20. For example, the pressure bar 30 can be raised and lowered by movement of the fastener component 20.

FIGS. 5-8 show an exemplary embodiment of the pressure bar 30. The pressure bar 30 includes a bottom section 32 and a first leg 34 and a second leg 30 extending upward from the bottom section 32. The bottom section includes a groove 38, for example a V-shaped groove to maximize contact with different sized conductors. Other shapes and configurations of the groove 38 can be used. First and second transitions 40, 42 connect the first and second legs 34, 36 to the bottom section 32 respectively. The transitions 40, 42 are curved and form a first shoulder 44 and a second shoulder 46, respectively. The transitions 40, 42 curve back in on themselves so that they engage the bottom section 32, allowing for greater compression and stability of the pressure bar 30. The transitions 40, 42 can include different configurations, for example a rectilinear configuration. The pressure bar 30 is formed from a single piece of material, for example sheet metal, although other configurations and materials can be used.

Figure 5:
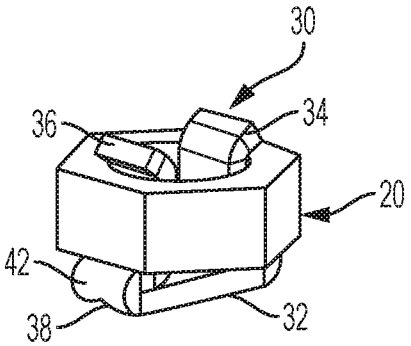
FIG. 5 is a side perspective view of a nut and an exemplary pressure bar.
Figure 6:
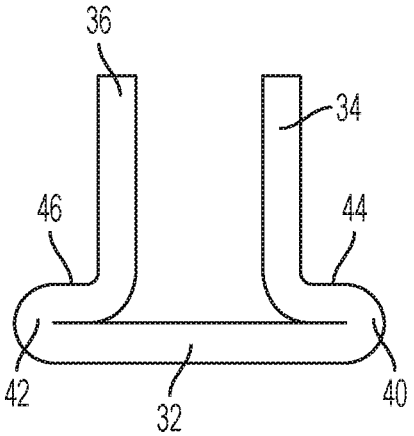
FIG. 6 is a front view of the pressure bar of FIG. 5.
Figure 7:
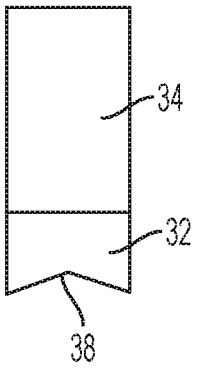
FIG. 7 is a side view of the pressure bar of FIG. 5.
Figure 8:
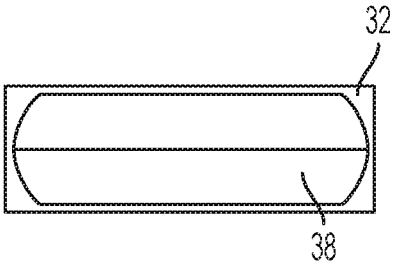
FIG. 8 is a bottom view of the pressure bar of FIG. 5.

The pressure bar 30 is positioned in the channel 18 so that the first and second legs 34, 36 extend between the first and second upright members 14, 16. The fastener component 20 is positioned over the pressure bar 30 so that the first and second legs 34, 36 extend through the opening of the fastener component 20. The top portion of the first and second legs 34, 36 can be bent to retain the pressure bar 30 in the fastener 20, as best shown in FIG. 5.

In operation, one or more conductors are positioned in the channel 18 and the pressure bar 30 is positioned in the channel 18 over the conductors. The legs 34, 36 of the pressure bar 30 can be bent over the top of the fastener component 20 prior to or after the insertion of the conductor. The fastener component 20 is tightened, moving the pressure bar 30 into contact with the conductors and securing the conductors in the channel 18.

The foregoing detailed description of the certain exemplary embodiments has been provided for the purpose of explaining the general principles and practical application, thereby enabling others skilled in the art to understand the disclosure for various embodiments and with various modifications as are suited to the particular use contemplated. This description is not necessarily intended to be exhaustive or to limit the disclosure to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present application, and are not intended to limit the structure of the exemplary embodiments of the present application to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

The invention claimed is:

1. An electrical connector, comprising:

a split bolt having a base, a first upright member, a second upright member, and a conductor receiving channel defined between the first and second upright members;

a fastener component having a top surface, a bottom surface, and an opening receiving the first and second upright members; and a pressure bar having a bottom section with a first and second bottom edge and an upper surface extending between the first and second bottom edge, a first leg, a second leg, a first transition, and a second transition, wherein the first transition and the second transition have a lower surface opposite the upper surface, wherein the lower surface of the first transition and the lower surface of the second transition engage the upper surface of the bottom section in an unstressed position, and the pressure bar movably received in the conductor receiving channel.

2. The electrical connector of claim 1, wherein the first upright member includes a first exterior thread and the second upright member includes a second exterior thread.

3. The electrical connector of claim 2, wherein the fastener component is threadably connected to the first and second upright members.

4. The electrical connector of claim 1, wherein at least a portion of the first and second legs are bent over the top surface of the fastener component.

5. The electrical connector of claim 1, wherein the first and second transitions are curved.

6. The electrical connector of claim 1, wherein the pressure bar includes a first shoulder and a second shoulder contacting the bottom surface of the fastener component.

7. The electrical connector of claim 1, wherein the bottom section includes a groove.

8. The electrical connector of claim 7, wherein the groove is substantially V-shaped.

9. The electrical connector of claim 1, wherein the pressure bar is formed from a single piece of sheet metal.

10. The electrical connector of claim 1, further comprising a spacer bar positioned in the conductor receiving channel between the base and the pressure bar.

11. A pressure bar for an electrical connector comprising:

a bottom section having a groove for contacting a conductor, the bottom section having a first and second bottom edge and an upper surface extending between the first and second bottom edge;

a first leg extending from the bottom section;

a second leg extending from the bottom section;

a first transition between the first leg and the bottom section forming a first shoulder, the first transition having a lower surface; and a second transition between the second leg and the bottom section forming a second shoulder, the second transition having a lower surface, wherein the lower surface of the first transition and the lower surface of the second transition engage the upper surface of the bottom section in an unstressed position, and wherein the groove extends along the bottom section and at least partially into the first transition and the second transition.

12. The pressure bar of claim 11, wherein the first and second transitions are curved.

13. The pressure bar of claim 11, wherein the first and second transitions contact the bottom section.

14. The pressure bar of claim 11, wherein the first transition includes a first shoulder and the second transition includes a second shoulder.

15. The pressure bar of claim 11, wherein the groove is substantially V-shaped.

16. The pressure bar of claim 11, wherein the pressure bar is formed from a single piece of sheet metal.

17. A method of making an electrical connection comprising:

inserting a conductor into a channel of a split bolt connector;

inserting a pressure bar into the channel, the pressure bar having a bottom section with a first and second bottom edge and an upper surface extending between the first and second bottom edge, a first leg, a second leg, a first transition and a second transition, wherein the first transition and the second transition have a lower surface opposite the upper surface, wherein the lower surface of the first transition and the lower surface of the second transition engage the upper surface of the bottom section in an unstressed position;

connecting a fastener component to the split bolt connector so that the first and second legs extend through an opening in the fastener component; and adjusting the position of the fastener component to move the pressure bar into engagement with the conductor.

18. The method of claim 17, wherein the fastener component is threadably connected to the split bolt connector.

19. The method of claim 17, further comprising bending the first leg and the second leg of the pressure bar over the top of the fastener component.

* * * * *